US008622641B2

(12) United States Patent
Lee

(10) Patent No.: US 8,622,641 B2
(45) Date of Patent: Jan. 7, 2014

(54) DOCUMENT-FEEDING ROLLER MECHANISM AND PRINTING APPARATUS HAVING THE SAME

(75) Inventor: Chieh-Hung Lee, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 130 days.

(21) Appl. No.: 13/295,245

(22) Filed: Nov. 14, 2011

(65) Prior Publication Data

US 2012/0288317 A1 Nov. 15, 2012

(30) Foreign Application Priority Data

May 10, 2011 (CN) ..... 2011 1 0125761

(51) Int. Cl.
*B41J 13/02* (2006.01)

(52) U.S. Cl.
USPC ..... 400/636.3; 400/636

(58) Field of Classification Search
USPC ..... 400/636.3
See application file for complete search history.

(56) References Cited

U.S. PATENT DOCUMENTS

| | | | | |
|---|---|---|---|---|
| 5,129,749 | A * | 7/1992 | Sato | 400/639 |
| 5,681,124 | A * | 10/1997 | Yasuoka | 400/636.1 |
| 5,947,615 | A * | 9/1999 | Yokoi | 400/56 |
| 6,343,787 | B1 * | 2/2002 | Kato et al. | 271/274 |
| 7,341,338 | B2 * | 3/2008 | Uwagaki et al. | 347/104 |
| 7,422,320 | B2 * | 9/2008 | Sugiura | 347/104 |
| 7,992,870 | B2 * | 8/2011 | Yamaguchi | 271/273 |
| 2005/0109450 | A1 * | 5/2005 | Skoglund et al. | 156/247 |
| 2006/0239750 | A1 * | 10/2006 | Huang et al. | 400/636.3 |
| 2006/0285909 | A1 * | 12/2006 | Peck et al. | 400/636.3 |

* cited by examiner

*Primary Examiner* — Anthony Nguyen
(74) *Attorney, Agent, or Firm* — Rosenberg, Klein & Lee

(57) ABSTRACT

A document-feeding roller mechanism includes a feeding roller assembly and a clamping-force adjusting module. The feeding roller includes a roller frame, a first roller unit, and a second roller unit. A document is conveyed by the first and second roller units through a printing module. The clamping-force adjusting module includes a cam unit and a resilient pressing unit. The resilient pressing unit is disposed between the roller frame and the cam unit. When the cam unit is rotated, the biasing force of the resilient pressing unit applied to the roller frame can be adjusted to change the document clamping force of the first and second roller units. Hence, just before a trailing end of the document is separated from the first and second roller units, the document clamping force can be reduced.

14 Claims, 9 Drawing Sheets

DOCUMENT-FEEDING ROLLER MECHANISM AND PRINTING APPARATUS HAVING THE SAME

CROSS-REFERENCE TO RELATED APPLICATION

This application claims priority of Chinese Application No. 201110125761.6, filed on May 10, 2011.

BACKGROUND OF THE INVENTION

1. Field of the Invention

This invention relates to a printing apparatus, and more particularly to a document-feeding roller mechanism and a printing apparatus having the same and being capable of adjusting the document clamping force.

2. Description of the Related Art

In a conventional printing apparatus, a document is clamped and conveyed by a feeding roller assembly to move through a printing module, and is ejected from the printing apparatus by a document-ejecting roller assembly disposed downstream of the printing module. During feeding of the document, the feeding roller assembly provides a clamping force to the document for pushing and moving the document toward the printing module.

While the document is passing through the printing module, since leading and trailing ends of the document are clamped by the feeding roller assembly and the document-ejecting roller assembly, respectively, the document is subjected to a pulling force. When the trailing end of the document is removed from the feeding roller assembly, the pulling force applied to the document disappears due to release of the clamping force of the feeding roller assembly, thereby resulting in a change in the document tension. Such a sudden tension change affects adversely the printing quality.

Moreover, since the clamping force of the feeding roller assembly to the document is fixed, in case of power failure occurring during a printing process, it is difficult to remove a document jammed in the feeding roller assembly from the conventional printing apparatus.

SUMMARY OF THE INVENTION

The object of this invention is to provide a document-feeding roller mechanism and a printing apparatus having the same, which can reduce adverse affection of the document clamping force of rollers on the printing quality.

According to an aspect of this invention, there is provided a document-feeding roller mechanism adapted for conveying a document through a printing module, the document having a trailing end, the document-feeding roller mechanism comprising:

a frame body;

a feeding roller assembly including a roller frame disposed rotatably on the frame body, a first roller unit disposed on the roller frame and adapted to be adjacent to the printing module, and a second roller unit in contact with the first roller unit so as to allow for movement of the document between the first and second roller units and toward the printing module; and a clamping-force adjusting module including a resilient pressing unit disposed on the frame body and providing a biasing force to the roller frame for biasing the first roller unit to contact the second roller unit, and a cam unit adjacent to and connected to the resilient pressing unit and rotatable relative to the frame body between a first angular position and a second angular position such that, when the trailing end of the document is moved to a position adjacent to and disposed upstream of the feeding roller assembly, the cam unit is controlled to rotate from the first angular position to the second angular position so as to reduce the biasing force of the resilient pressing unit on the roller frame and, thus, the clamping force of the first and second roller units to the document.

According to another aspect of this invention, there is provided a printing apparatus comprising:

a housing;

a printing module disposed in the housing and adapted to permit a document to move therethrough along a direction;

a document-feeding roller mechanism disposed in the housing and adapted for moving the document through the printing module in the direction, the document-feeding roller mechanism including a frame body, a feeding roller assembly including a roller frame disposed rotatably on the frame body, a first roller unit disposed on the roller frame and adjacent to the printing module, and a second roller unit in contact with the first roller unit so as to allow for movement of the document between the first and second roller units and toward the printing module, and a clamping-force adjusting module including a resilient pressing unit disposed on the frame body and providing a biasing force to the roller frame for biasing the first roller unit to contact the second roller unit, and a cam unit adjacent to and connected to the resilient pressing unit and rotatable relative to the frame body between a first angular position and a second angular position such that, when the trailing end of the document is moved to a position adjacent to and disposed upstream of the feeding roller assembly, the cam unit is controlled to rotate from the first angular position to the second angular position so as to reduce the biasing force of the resilient pressing unit on the roller frame and, thus, the clamping force of the first and second roller units to the document.

The effect of this invention is that, through cooperation between the cam unit and the resilient pressing unit of the clamping-force adjusting module, the document clamping force of the feeding roller assembly can be reduced just before the document is removed from the first and second roller units, so as to diminish a change in a pulling force applied to the document while the document is being printed, thereby improving the printing quality.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
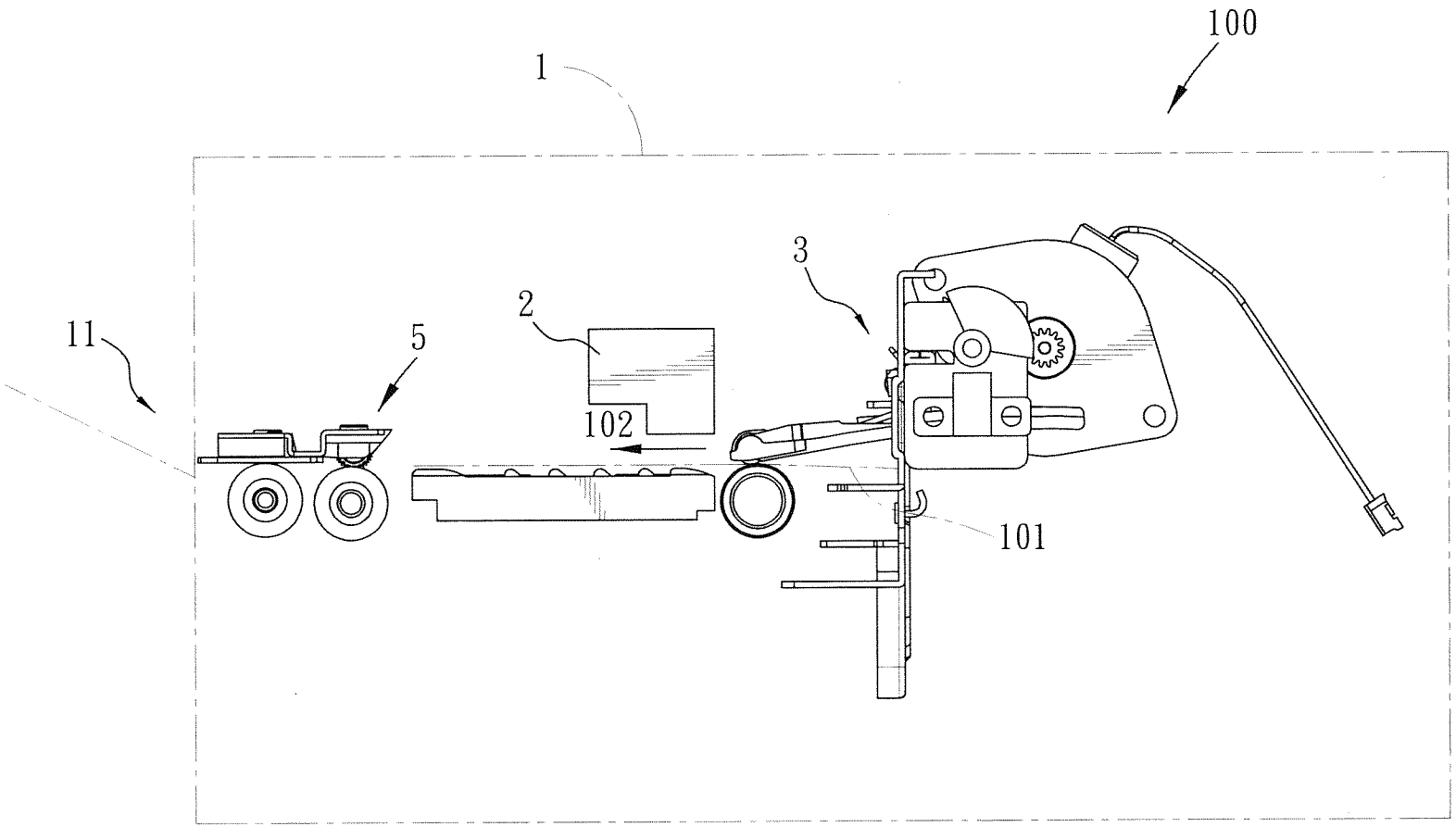
FIG. 1 is a schematic side view of the preferred embodiment of a printing apparatus according to this invention.

Referring to FIG. 1, the preferred embodiment of a printing apparatus 100 according to this invention includes a housing 1, a printing module 2 disposed in the housing 1, a document-feeding roller mechanism 3, and a document-ejecting roller assembly 5. The printing apparatus 100 further includes other roller assemblies (not shown), as well as driving mechanisms and control circuits (not shown) that are disposed for driving and controlling operation of the roller assemblies and the printing module 2.

The housing 1 has a document-ejecting port 11. A document 101 is conveyed by the document-feeding roller mechanism 3 to move through the printing module 2 in a direction 102, and is subsequently ejected from the housing 1 through the document-ejecting port 11 by the document-ejecting roller assembly 5.

Figure 2:
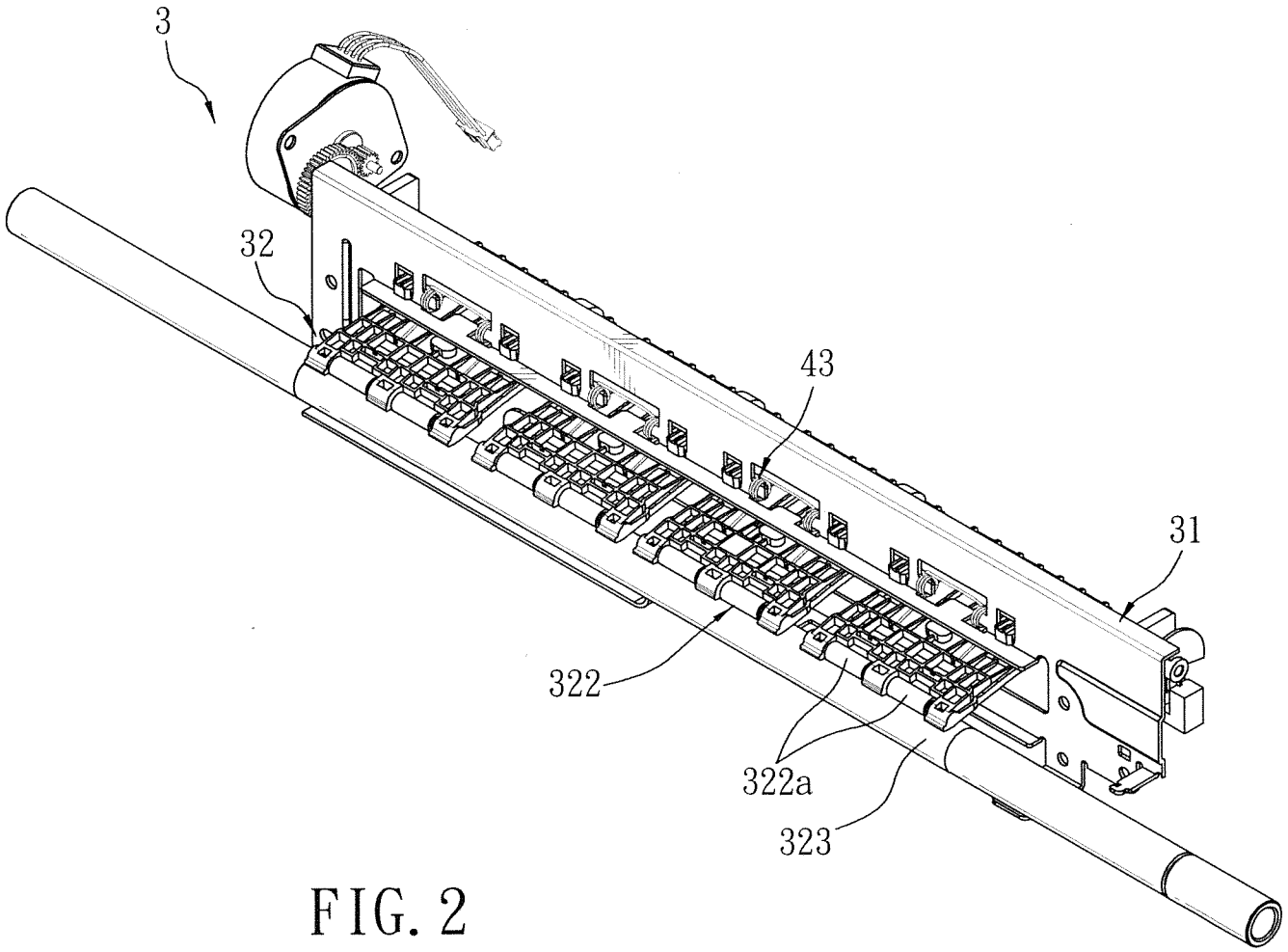
FIG. 2 is a perspective view of a document-feeding roller mechanism of the preferred embodiment.
Figure 3:
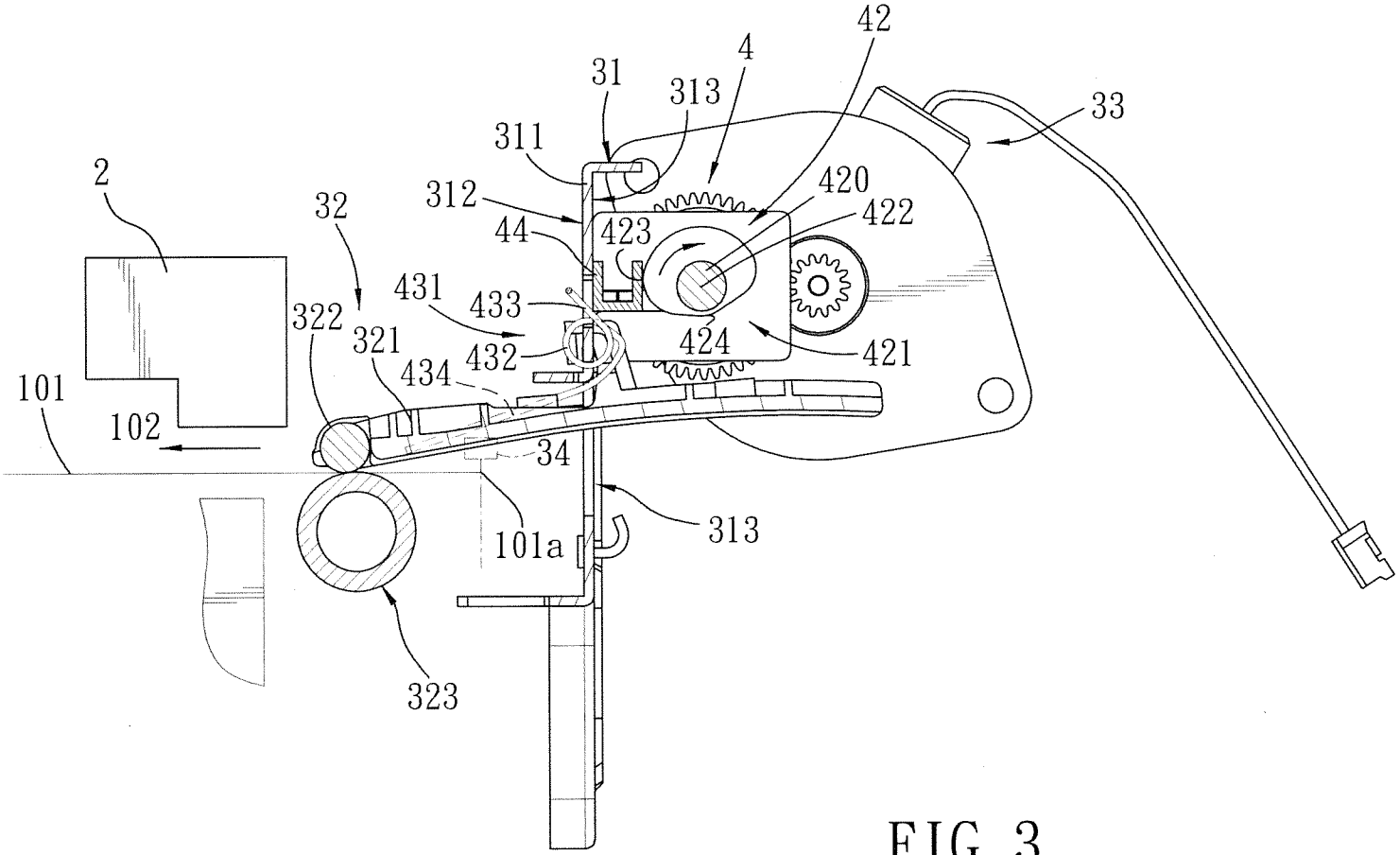
FIG. 3 is a sectional view of the preferred embodiment, illustrating that a cam unit of the document-feeding roller mechanism is disposed at a first angular position.

With further reference to FIGS. 2 and 3, the document-feeding roller mechanism 3 includes a frame body 31, a feeding roller assembly 32, a clamping-force adjusting module 4, a kinetic power unit 33, and a sensor 34. In this embodiment, the frame body 31 is adjacent to the printing module 2, and includes an upright plate 311 having a first side surface 312 that faces the printing module 2, and a second side surface 313 that is opposite to the first side surface 312 and that faces away from the printing module 2. The feeding roller assembly 32 includes a plurality of roller frames 321, a first roller unit 322, and a second roller unit 323. The roller frames 321 are generally plate-shaped, are arranged in a row, and extend through the upright plate 311. The first roller unit 322 includes a plurality of first rollers 322*a* disposed respectively on the roller frames 321 and adjacent to the printing module 2. The second roller unit 323 is cylindrical, is disposed under and in contact with the first roller unit 322, and is positioned such that the document 101 can move between the first and second roller units 322, 323. The first and second roller units 322, 323 cooperate to feed the document 101 into the printing module 2. In this embodiment, two ends of the second roller unit 323 are supported on the frame body 31.

Figure 4:
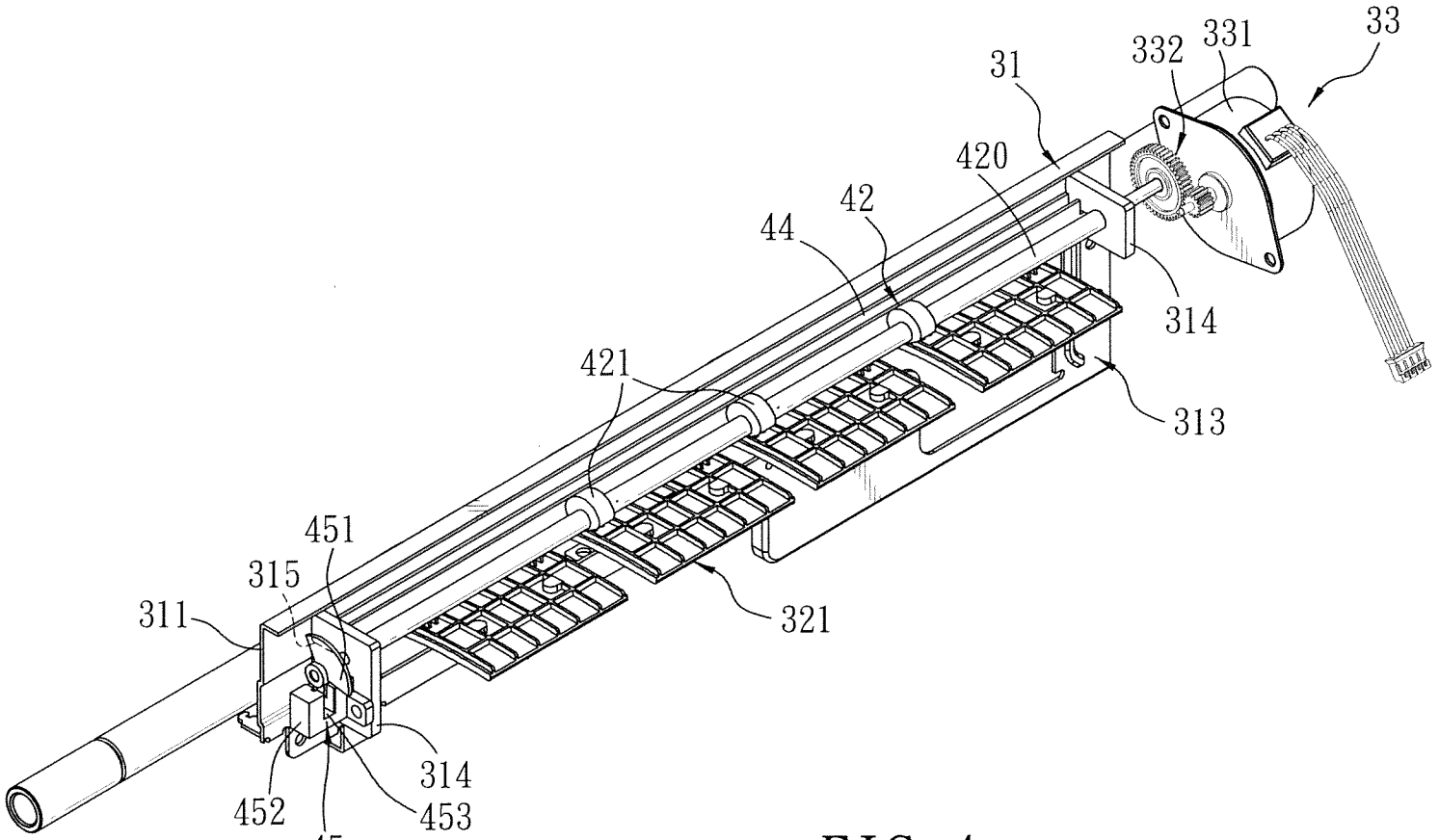
FIG. 4 is another perspective view of the document-feeding roller mechanism of the preferred embodiment, viewed from a different angle.

With further reference to FIG. 4, the clamping-force adjusting module 4 is operable for adjusting the clamping force of the first and second roller units 322, 323 to the document 101. The clamping-force adjusting module 4 includes a cam unit 42, a resilient pressing unit 43, and a movable member 44. The cam unit 42 and the movable member 44 are positioned such that the second side surface 313 of the upright plate 311 faces the cam unit 42 and the movable member 44. The movable member 44 is disposed between the upright plate 311 and the cam unit 42, and has two opposite sides abutting respectively against the resilient pressing unit 43 and the cam unit 42.

In this embodiment, the movable member 44 is elongated, and the frame body 31 further includes two side plates 314 extending from the second side surface 313 of the upright plate 311 and spaced apart from each other. Each of the side plates 314 is formed with a guide slot 315. The guide slots 315 in the side plates 314 are aligned with each other. Two ends of the movable member 44 extend respectively and movably into the guide slots 315, so as to guide movement of the movable member 44 toward and away from the upright plate 311.

The cam unit 42 includes a shaft 420 and a plurality of cams 421 disposed on the shaft 420. Two ends of the shaft 420 extend respectively and rotatably through the side plates 314. Each of the cams 421 has a rotating center 522 coaxial with the axis of the shaft 420, a first camming surface portion 423, and a second camming surface portion 424 nearer to the rotating center 422 than the first camming surface portion 423.

Figure 5:
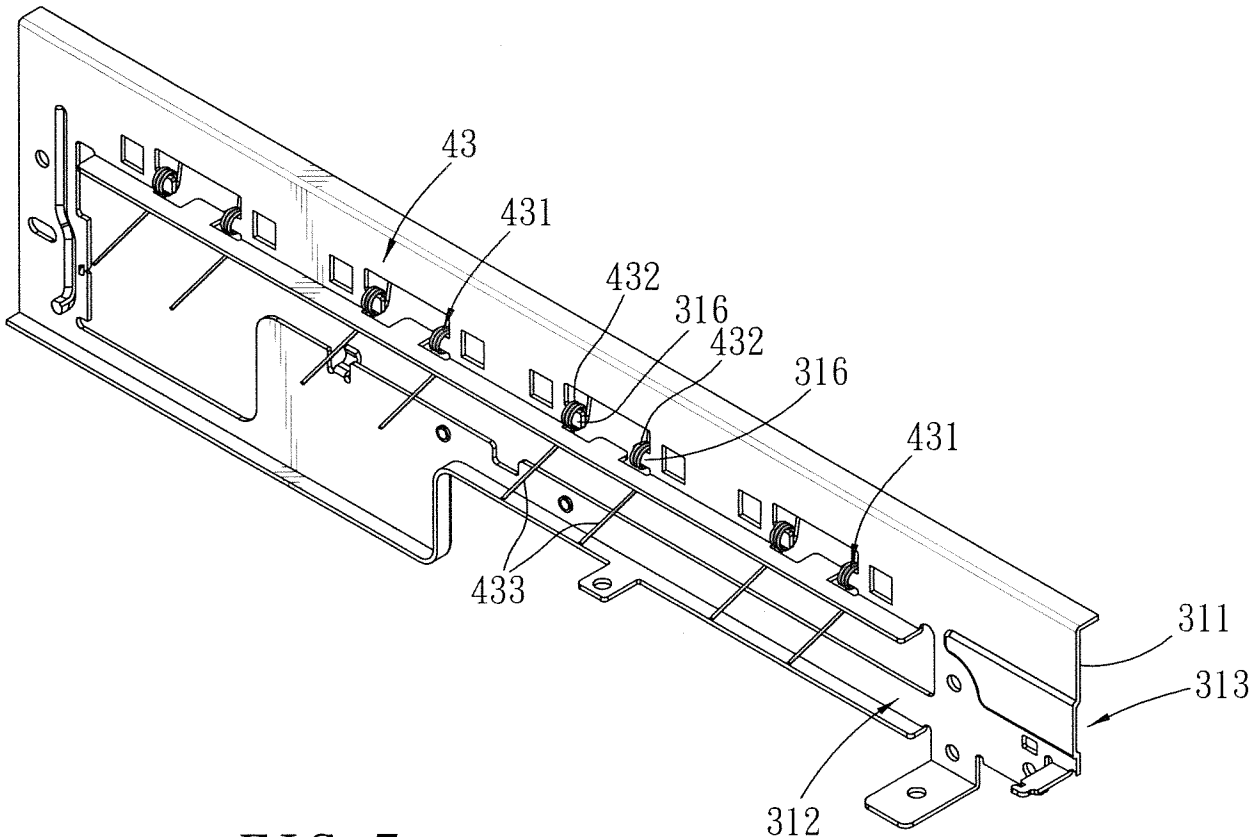
FIG. 5 is a perspective view of an upright plate and a resilient pressing unit of the preferred embodiment.
Figure 6:
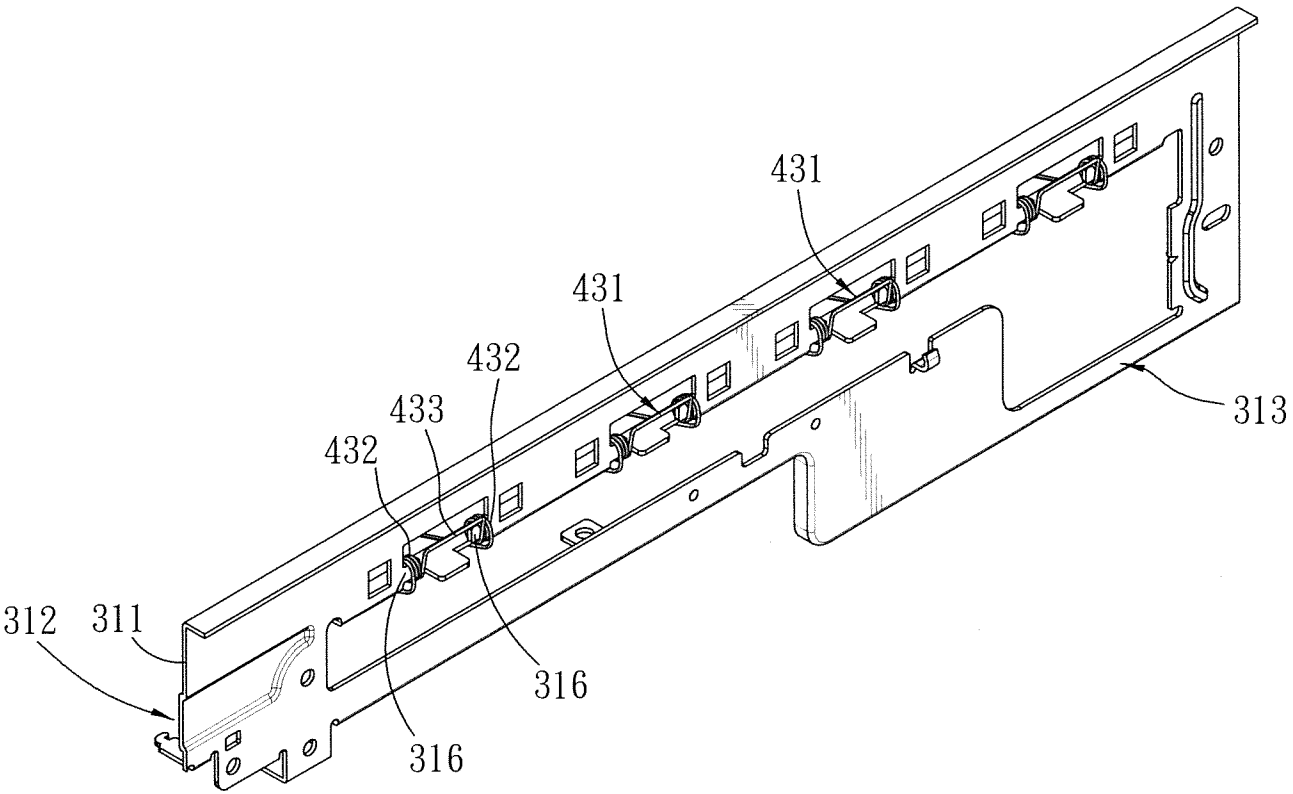
FIG. 6 is another perspective view of the upright plate and the resilient pressing unit of the preferred embodiment, viewed from a different angle.

With reference to FIGS. 5 and 6, the resilient pressing unit 43 includes a plurality of torsion springs 431 disposed on the upright plate 311. Each of the torsion springs 431 has two coiled portions 432, a first resilient arm 433 connected between the coiled portions 432, and two second resilient arms 434. In this embodiment, the first resilient arm 433 is U-shaped, the two coiled portions 432 are connected respectively to two opposite ends of the first resilient arm 433, and the second resilient arms 434 are connected respectively to the coiled portions 432, and extend in the same direction. The upright plate 311 is formed with a plurality of spaced-apart lugs 316 permitting the coiled portions 432 of the torsion springs 431 to be sleeved respectively thereon. The first resilient arms 433 of the torsion springs 431 abut against the movable member 44. The second resilient arms 434 of the torsion springs 431 extend through the upright plate 311, and press respectively against the roller frames 321 so as to biasing the first roller unit 322 to contact the second roller unit 323.

In an alternative embodiment, the movable member 44 is omitted, and the first resilient arms 433 of the torsion springs 431 abut directly against the cam unit 42. In another alternative embodiment, only one torsion spring 431 and only one cam 421 are provided.

The sensor 34 is disposed on a bottom surface of one of the roller frames 321 between the frame body 31 and the first roller unit 322. In this embodiment, the sensor 34 is a light shielding sensor.

Figure 7:
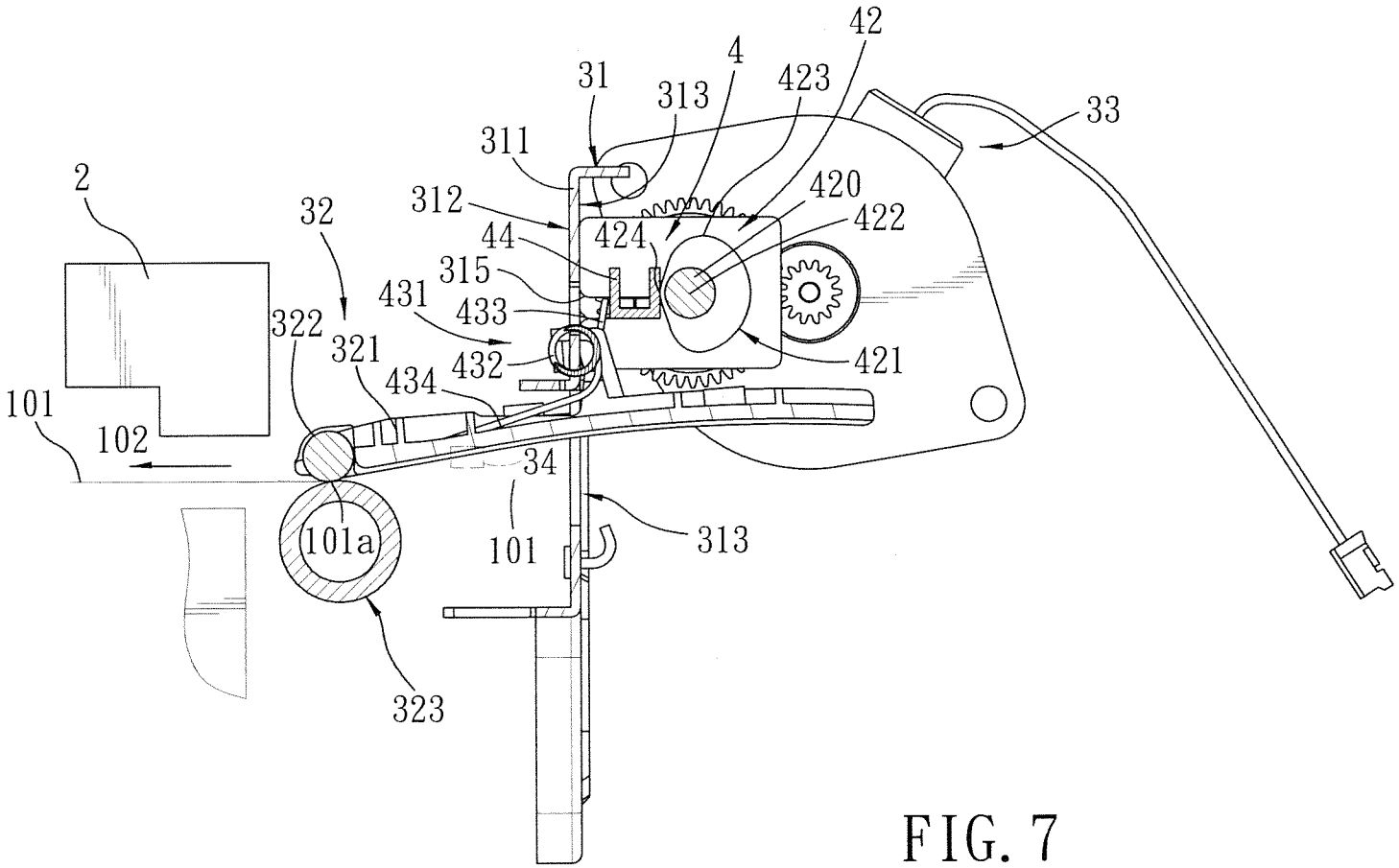
FIG. 7 is a view similar to FIG. 3 but illustrating that the cam unit is disposed at a second angular position.

With further reference to FIG. 7, the kinetic power unit 33 includes a power source 331 and a transmission 332 for transmitting power from the power source 331 to an end of the shaft 420. In this embodiment, the power source 331 is a motor, and the transmission 332 is a gearing. The power source 331 can drive the transmission 332 to thereby rotate the shaft 420 and, thus, the cams 421. Operation of one of the cams 421 will be described in the following. When the cam 421 rotates to a first angular position shown in FIG. 3, the first camming surface portion 423 comes into contact with the movable member 44. When the cam 421 rotates to a second angular position shown in FIG. 7, the second camming surface portion 423 comes into contact with the movable member 44. As such, rotation of the cam 421 from the first angular position to the second angular position results in movement of the movable member 44 away from the upright plate 311, so that a pressure applied from the second resilient arms 434 to the roller frames 321 is reduced. Hence, the document clamping force of the first and second roller units 322, 323 is also reduced. Conversely, rotation of the cam 421 from the second angular position to the first angular position results in movement of the movable member 44 toward the upright plate 311, so that the pressure applied from the second resilient arms 434 to the roller frames 321 is increased. Hence, the document clamping force of the first and second roller units 322, 323 is also increased.

In this embodiment, the cam unit 42 is controlled such that, when the document 101 is fed toward the printing module 2 by the feeding roller assembly 32, and when a trailing end 101*a* of the document 101 has not yet moves through the sensor 34, the cam 422 is disposed at the first angular position, so that the first and second roller units 322, 323 provide a large document clamping force to feed the document 101 toward the printing module 2; and when the trailing end 101*a* of the document 101 moves past the sensor 34 (i.e., when the document 101 moves to a position adjacent to and disposed upstream of the first and second roller units 322, 323), and when the sensor 34 no longer detects the document 101, the sensor 34 emits a sensing signal to the power source 331. Upon receiving the sensing signal, the power source 331 activates the shaft 420 to rotate the cam 421 from the first angular position to the second angular position. Hence, the document clamping force of the first and second roller units 322, 323 are reduced in stages. In other words, a pulling force applied cooperatively by the feeding roller assembly 32 and the document-ejecting roller assembly 5 to the document 101 is released progressively.

When the cam 341 rotates to the second angular position, a pressure applied from the movable member 44 to the torsion springs 431 is reduced. At this time, although the first roller unit 322 still abuts against the second roller unit 323, the document clamping force is reduced significantly. Hence, when the trailing end 101*a* of the document 101 separates from the first and second roller units 322, 323, a sudden change in the document tension caused due to a sudden reduction in the document pulling force can be avoided, so that adverse affection on the printing quality can be diminished.

Figure 8:
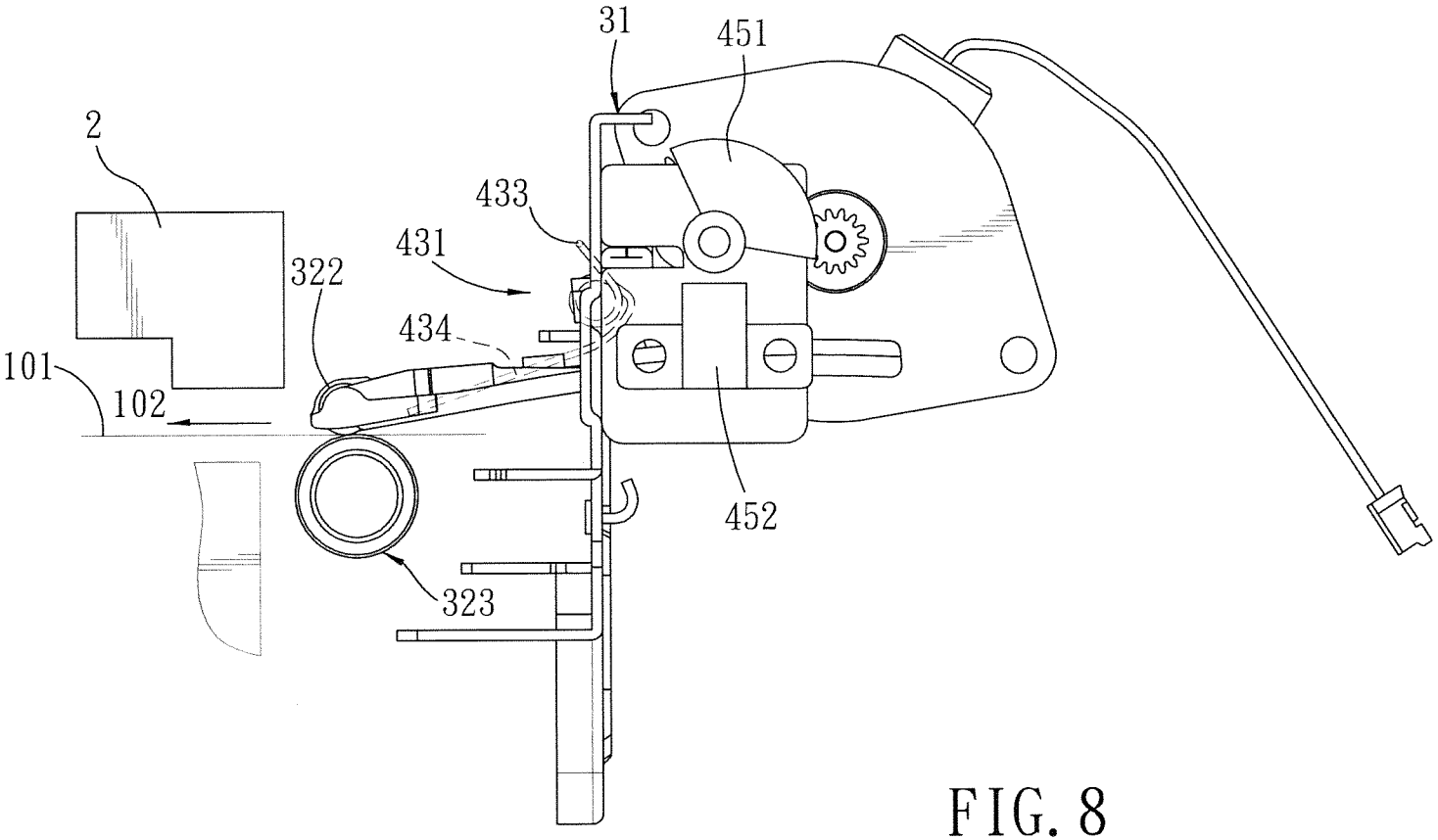
FIG. 8 is a side view of the preferred embodiment, illustrating that a rotating member of the document-feeding roller mechanism has not yet moved into a cam-position sensor.

With particular reference to FIGS. 4 and 8, to rotate the cam 421 between the first and second angular positions, the document-feeding roller mechanism 3 further includes a cam-position sensing unit 45. The cam-position sensing unit 45 includes a rotating member 451 co-rotatable with the cam unit 42, and a cam-position sensor 452 for sensing the rotating member 451. In this embodiment, the rotating member 451 is generally shaped as a sector, and is disposed on an end of the shaft 41, and is adjacent to one of the side plates 314. The cam-position sensor 452 is disposed on the side plate 314 adjacent to the rotating member 451, is a U-shaped light shielding sensor, and has a notch 453. The rotating member 452 is rotatable into the notch 453, so that the cam-position sensor 452 generates a control signal.

Figure 9:
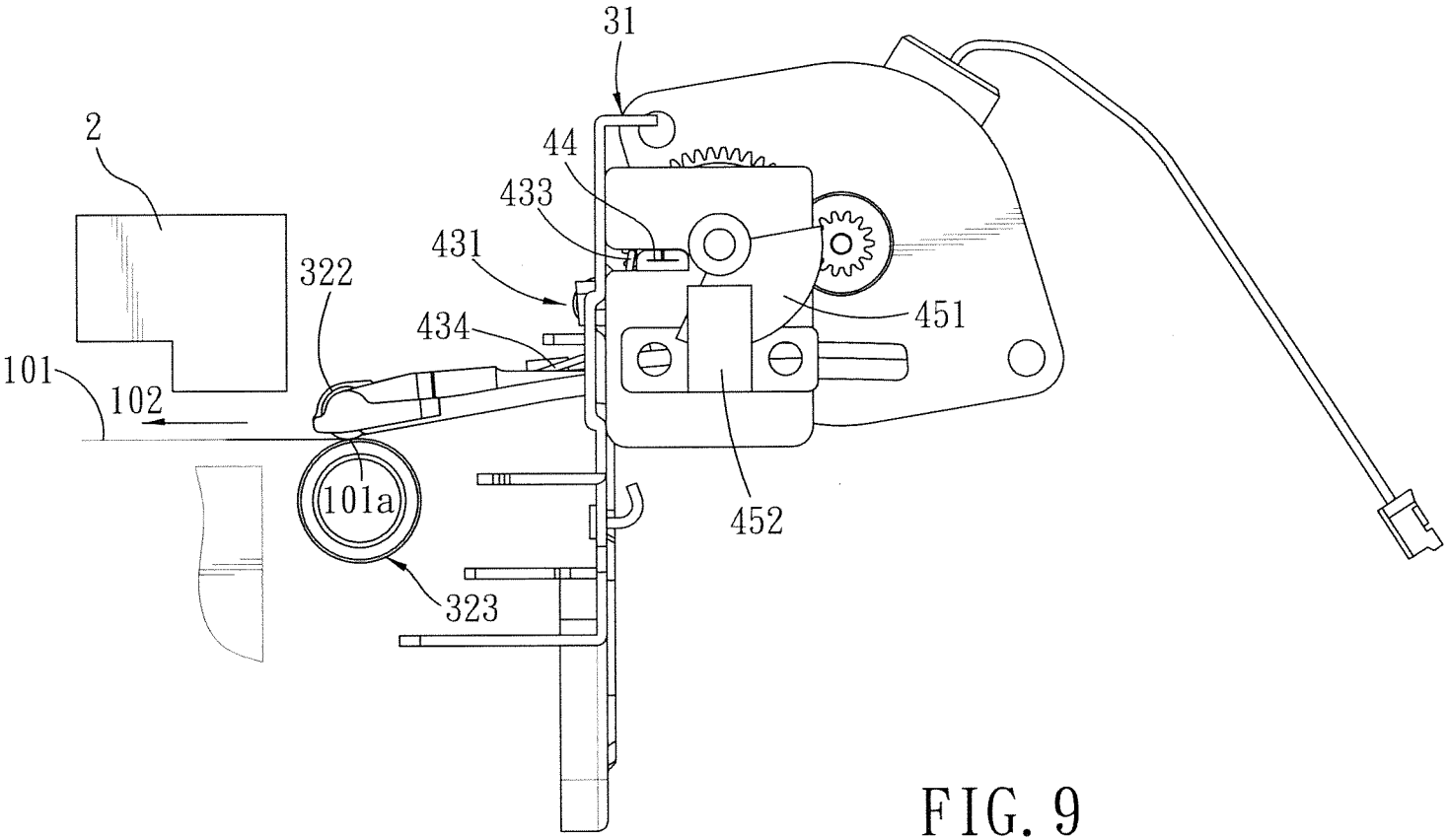
FIG. 9 is a view similar to FIG. 8 but illustrating that the rotating member is moved into the cam-position sensor.

In this embodiment, the rotating member 451 is controlled such that, when the cam 421 is disposed at the first angular position, the rotating member 451 is not moved into the notch 453 in the cam-position sensor 452, and when the cam 421 rotates to the second angular position, and when the trailing end 101*a* of the document 101 separates from the first and second roller units 322, 323, the rotating member 451 is moved into the notch 453 in the cam-position sensor 452, as shown in FIG. 9, so that the cam-position sensor 452 emits the control signal to the power source 311. Upon receiving the control signal from the cam-position sensor 452, the power source 311 drives the cam 421 to rotate from the second angular position to the first angular position, so as to increase the document clamping force of the first and second roller units 322, 323 for feeding the next document 101 toward the printing module 2.

In this embodiment, the rotating member 451 is designed such that, after reaching a position in the notch 453 in the cam-position sensor 452, where the light can be shielded, it continues to rotate an angle of about 10° to 15°. In this manner, it is ensured that the light can be shielded even when the printing apparatus is subjected to a vibration.

Since the power source 331 of the document-feeding roller mechanism 3 is disposed for driving the clamping-force adjusting module 4, during program initialization, it can be designed to drive rotation of the cam 421 from the first angular position to the second angular position when the document 101 is jammed without operation of the sensor 34. In this manner, since the document clamping force of the feeding roller assembly 32 is reduced, the jammed document 101 can be removed with ease.

Alternatively, the torsion springs 431 may be replaced with tension springs or compression springs that are disposed between the cam unit 42 and the roller frames 321.

In view of the above, through cooperation between the cam unit 42 and the resilient pressing unit 43 of the clamping-force adjusting module 4, the document clamping force of the feeding roller assembly 32 can be adjusted according to the feeding state of the document 101 such that, just before the document 101 is moved into the feeding roller assembly 32, the pulling force applied by the feeding roller assembly 32 and the document-ejecting roller assembly 5 to the document 101 can be released gradually, thereby preventing a sudden change in the document tension occurring when the document 101 separates from the feeding roller assembly 32, so as to improving the printing quality. Thus, the object of this invention is achieved.

Furthermore, after the trailing end 101*a* of the document 101 moves past the sensor 34, and before it separates from the feeding roller assembly 32, since it is subjected to a smaller clamping force, if the document 101 is jammed due to power failure, it can be removed easily from the feeding roller assembly 32.

With this invention thus explained, it is apparent that numerous modifications and variations can be made without departing from the scope and spirit of this invention. It is therefore intended that this invention be limited only as indicated by the appended claims.

I claim:

1. A document-feeding roller mechanism adapted for conveying a document through a printing module, the document having a trailing end, said document-feeding roller mechanism comprising:

a frame body including an upright plate having a first side surface that is adapted to face the printing module, and a second side surface opposite to said first side surface, and two side plates extending from said second side surface of said upright plate, each of said side plates being formed with a guide slot;

a feeding roller assembly including a roller frame disposed rotatably on said frame body, a first roller unit disposed on said roller frame and adapted to be adjacent to the printing module, and a second roller unit in contact with said first roller unit so as to allow for movement of the document between said first and second roller units and toward the printing module; and a clamping-force adjusting module including a resilient pressing unit disposed on said frame body and providing a biasing force to said roller frame for biasing said first roller unit to contact said second roller unit, a cam unit disposed between said side plates, adjacent to and connected to said resilient pressing unit and rotatable relative to said frame body between a first angular position and a second angular position such that, when the trailing end of the document is moved to a position adjacent to and disposed upstream of said feeding roller assembly, said cam unit is controlled to rotate from the first angular position to the second angular position so as to reduce the biasing force of said resilient pressing unit on said roller frame and, thus, the clamping force of said first and second roller units to the document, and an elongated movable member disposed between said upright plate and said cam unit and having two opposite ends extending respectively and movably into said guide slots in said side plates, such that said movable member can be driven by said cam unit to move toward said upright plate, and can be biased by said resilient pressing unit to move away from said upright plate.

2. The document-feeding roller mechanism as claimed in claim 1, wherein said clamping-force adjusting module further includes a cam-position sensing unit, said cam-position sensing unit including a rotating member and a cam-position sensor disposed on said frame body, said rotating member being disposed on said cam unit and being co-rotatable with said cam unit to move into said cam-position sensor.

3. The document-feeding roller mechanism as claimed in claim 1, wherein said resilient pressing unit includes at least one torsion spring, said torsion spring having a first resilient arm and a second resilient arm, said first resilient arm being movable by said cam unit, said second resilient arm pressing against said roller frame.

4. The document-feeding roller mechanism as claimed in claim 1, wherein said cam unit is rotatable relative to said frame body to move said movable member relative to said frame body, said movable member pressing against said resilient pressing unit.

5. The document-feeding roller mechanism as claimed in claim 1, further comprising a sensor disposed between said frame body and said first roller unit, said sensor being adapted for detecting the trailing end of the document.

6. The document-feeding roller mechanism as claimed in claim 2, wherein said cam unit includes a shaft and at least one cam disposed on said shaft, said shaft having two opposite ends extending respectively through said side plates, said rotating member being disposed on one of said ends of said shaft.

7. The document-feeding roller mechanism as claimed in claim 6, further comprising a power unit, said power unit including a power source, and a transmission interconnecting said power source and said shaft.

8. A printing apparatus comprising:

a housing;

a printing module disposed in said housing and adapted to permit a document to move therethrough along a direction;

a document-feeding roller mechanism disposed in said housing and adapted for moving the document through the printing module in the direction, said document-feeding roller mechanism including a frame body including an upright plate having a first side surface that is adapted to face the printing module, and a second side surface opposite to said first side surface, and two side plates extending from said second side surface of said upright plate, each of said side plates being formed with a guide slot, a feeding roller assembly including a roller frame disposed rotatably on said frame body, a first roller unit disposed on said roller frame and adjacent to said printing module, and a second roller unit in contact with said first roller unit so as to allow for movement of the document between said first and second roller units and toward the printing module, and a clamping-force adjusting module including a resilient pressing unit disposed on said frame body and providing a biasing force to said roller frame for biasing said first roller unit to contact said second roller unit, a cam unit adjacent to and connected to said resilient pressing unit and rotatable relative to said frame body between a first angular position and a second angular position, and an elongated movable member disposed between said side plates such that, when the trailing end of the document is moved to a position adjacent to and disposed upstream of said feeding roller assembly, said cam unit is controlled to rotate from the first angular position to the second angular position so as to reduce the biasing force of said resilient pressing unit against said roller frame and, thus, the clamping force of said first and second roller units to the document, said movable member being disposed between said upright plate and said cam unit and having two opposite ends extending respectively and movably into said guide slots in said side plates, such that said movable member can be driven by said cam unit to move toward said upright plate, and can be biased by said resilient pressing unit to move away from said upright plate.

9. The printing apparatus as claimed in claim 8, wherein said clamping-force adjusting module further includes a cam-position sensing unit, said cam-position sensing unit including a rotating member and a cam-position sensor disposed on said frame body, said rotating member being disposed on said cam unit and being co-rotatable with said cam unit to move into said cam-position sensor.

10. The printing apparatus as claimed in claim 8, wherein said resilient pressing unit includes at least one torsion spring, said torsion spring having a first resilient arm and a second resilient arm, said first resilient arm being movable by said cam unit, said second resilient arm pressing against said roller frame.

11. The printing apparatus as claimed in claim 8, wherein said cam unit is rotatable relative to said frame body to move said movable member relative to said frame body, said movable member pressing against said resilient pressing unit.

12. The printing apparatus as claimed in claim 8, further comprising a sensor disposed between said frame body and said first roller unit, said sensor being adapted for detecting a trailing end of the document.

13. The printing apparatus as claimed in claim 9, wherein said cam unit includes a shaft and at least one cam disposed on said shaft, said shaft having two opposite ends extending respectively through said side plates, said rotating member being disposed on one of said ends of said shaft.

14. The printing apparatus as claimed in claim 13, further comprising a power unit, said power unit including a power source, and a transmission interconnecting said power source and said shaft.

* * * * *